US005655614A

United States Patent [19]

Azar

[11] Patent Number: 5,655,614

[45] Date of Patent: Aug. 12, 1997

[54] SELF-CENTERING POLYCRYSTALLINE DIAMOND CUTTING ROCK BIT

[75] Inventor: Michael G. Azar, The Woodlands, Tex.

[73] Assignee: Smith International, Inc., Houston, Tex.

[21] Appl. No.: 735,316

[22] Filed: Oct. 25, 1996

Related U.S. Application Data

[63] Continuation of Ser. No. 360,233, Dec. 20, 1994, abandoned.

[51] Int. Cl.[6] ..... E21B 10/00

[52] U.S. Cl. ..... 175/404; 175/405.1

[58] Field of Search ..... 175/403, 404, 175/405.1, 420.2, 387, 333, 336

[56] References Cited

U.S. PATENT DOCUMENTS

| | | | |
|---|---|---|---|
| 3,323,604 | 6/1967 | Henderson | 175/244 |
| 3,635,296 | 1/1972 | Lebourg | 175/404 |
| 4,352,400 | 10/1982 | Grappendorf et al. | 175/394 X |
| 4,538,691 | 9/1985 | Dennis | 175/405.1 X |
| 4,640,374 | 2/1987 | Dennis | 175/405.1 X |
| 4,694,916 | 9/1987 | Ford | 175/249 |
| 5,010,789 | 4/1991 | Brett et al. | 76/108.2 |
| 5,176,212 | 1/1993 | Tandberg | 175/404 X |
| 5,361,859 | 11/1994 | Tibbitts | 175/286 |

FOREIGN PATENT DOCUMENTS

| | | |
|---|---|---|
| 694925 | 7/1953 | United Kingdom . |
| 1357640 | 6/1974 | United Kingdom . |
| 60735 | 5/1981 | United Kingdom . |

*Primary Examiner*—Roger J. Schoeppel
*Attorney, Agent, or Firm*—Christie, Parker & Hale, LLP

[57] ABSTRACT

A self-centering drill bit includes a head portion having a plurality of polycrystalline diamond compact cutting elements arranged in blades that extend outwardly away from a surface of the bit. A cavity is centrally located on the head portion and is formed between adjacent blade ends. The cavity includes wall portions defined by the blade end portions. The cavity serves to house a core portion that is formed during drilling operation of the bit. The head portion is balanced to form and transmit a force from a designated wall portion to the core portion within the cavity. At least the designated wall portion includes a low friction abrasion resistant surface. The cavity includes a rigid element extending outwardly away from the head portion to reduce the core within the cavity upon contact. The force transmitted to the core portion causes a countering force to be imposed by the core to the wall portion that keeps the bit aligned with its rotational axis and, thus prevents whirling.

29 Claims, 2 Drawing Sheets

SELF-CENTERING POLYCRYSTALLINE DIAMOND CUTTING ROCK BIT

CROSS-REFERENCE TO RELATED APPLICATION

This is a continuation of application Ser. No. 08/360,233, filed Dec. 20, 1994 now abandoned.

FIELD OF THE INVENTION

The present invention relates generally to drill bits used for drilling subterranean formations such as oil wells and the like and, more particularly, this invention relates to a polycrystalline diamond drill bit having a modified configuration that serves to center the drill bit along its axis of rotation within a bore hole during operation.

BACKGROUND OF THE INVENTION

Conventional polycrystalline diamond drill or drag bits used for drilling subterranean formations generally have a plurality of polycrystalline diamond cutting elements that protrude outwardly from the bit surface and that are arranged in blades that each extend along an axis running along the bit from a face portion of the bit, over a shoulder portion, and to a gauge portion of the bit. In service, the cutting elements disposed at the shoulder portion are typically exposed to more aggressive wear due to both axial and radial forces that are directed onto the bit. Additional blades are oftentimes placed along the shoulder portion, increasing the density of cutting elements along the shoulder portion and, thereby, minimizing the effect of such aggressive wear.

As the drill bit is rotated in the bore hole the engagement of each cutting element within the hole creates forces that are imparted to the drill bit. The sum of these forces result in the formation of a unified force of single direction that is imposed on the drill bit and that causes the drill bit to track to one side of the hole in a direction away from its axis of rotation. As the drill bit is rotated within the hole out of its axis of rotation, interaction of the cutting elements against the hole side wall causes the drill bit to vibrate. The vibrations cause abnormally aggressive wear and impact damage to the drill bit, ultimately reducing bit service life.

Bits known in the art have been configured to reduce whirl and are referred to as Anti-Whirl bits. Such a bit is disclosed in U.S. Pat. No. 5,010,789 and is typically configured having low friction pads disposed along the shoulder and gauge portion of the bit. Accordingly, to accommodate the low friction pads, the shoulder and gauge portions are constructed having a reduced cutter element density, e.g., up to 20 percent fewer cutter elements than a conventional polycrystalline diamond drill bit. To ensure effective functioning of the low friction pads in reducing whirling, it is necessary that the operating parameters of the bit, e.g., revolution speed (RPM) and weight-on-bit, be limited to a defined window so that interaction between the cutter elements and the hole are sure to impose a force on the bit that is directed along the low friction pads. Operating the Anti-Whirling bit outside of the defined window can cause a force to be directed to the shoulder and gauge portion of the bit having the cutting elements. This not only causes the bit to move off-track from its axis of rotation, or whirl, but also causes aggressive wear to take place at the aforementioned shoulder and gauge portion of the bit. Accordingly, operating the anti-whirl bit outside of the limited window of operating parameters can ultimately result in the premature failure of the bit. Because the Anti-Whirl bit can only operate within the narrow window, its use is limited to only particular applications.

Core or coring bits are known in the art and are configured to form a core portion from the formation being drilled by the rotational action of the bit. The core bit is configured having a cutting portion disposed along a face and shoulder portion of the bit. The cutting portion extends a distance into an annular opening in the center of the face portion of the bit. The cutting portion may comprise a plurality of cutting elements that project outwardly away from the bit face and shoulder surfaces. Operation of the core bit causes the cutting portion of the bit to engage the formation, creating a core portion that passes into and through the annular opening.

The formation of the core portion and housing of such portion with the annular opening during drilling action of the bit does have some effect on centering the bit. However, whatever effect the core bit may have on centering the bit is overcome by the forces that are directed on the bit during drilling operation by interaction of the cutting portion of the bit with the bore hole, causing the coring bit to whirl and rotate off track from its rotational axis. Additionally, in conventional core bits the bit must be removed from the hole after drilling a short length so that the core can be removed. Therefore, the use of such core bits are typically limited to drilling short sections of a bore hole. Core bits are also only used in drilling straight line holes and, thus, cannot be used for directional drilling.

Some core bits are configured having a core ejector mechanism that facilitates the removal of the core portion from the bit without having to remove the bit from the bore hole. U.S. Pat. Nos. 4,694,916 and 3,323,604 each disclose a coring drill bit that includes a type of core breaker that facilitates breakage of the core and transportation of the broken core portion through the bit to the annulus. The advantage of a core comprising such an ejector is that it permits use of the bit in drilling long sections, as the core formed by the bit is ejected from the bit towards the annulus during the drilling operation. However, use of the bit comprising a core ejector is limited to drilling hard formations, to facilitate removal of the core portion, and to straight-line drilling.

U.S. Pat. No. 3,635,296 discloses a drill bit constructed having a crown portion comprising a matrix of cutting elements disposed thereon, and an annular cavity disposed within a center of the bit about the axis of rotation. The cutting elements extend a distance into the annular cavity. A cutting wheel is located within the annular opening and has a cutting surface positioned perpendicular to the opening. During drilling operation of the bit the matrix of cutting elements act to form a core portion from the formation that travels into the annular cavity. The cutting wheel acts to crush the core portion once it has traveled a distance through the cavity. The broken core portions are removed from the cavity through passages via hydraulic transport provided by drilling fluid.

Although this bit embodiment does have some effect on aiding the centering of the bit along its axis of rotation during operation, e.g., by the action of forming a core portion and housing the same within the cavity, the bit does not include a means for directing the forces imposed on the bit to a designated portion of the bit. Accordingly, the undirected forces imposed on the bit by the interaction of the cutting elements with the bore hole go unchecked and result in bit whirl and aggressive wear of the bit's cutting elements, thereby, reducing the service life of the bit.

None of the above-mentioned bits known in the art are configured in a manner that is effective in reducing bit whirling and keeping a drill bit on-line with its rotational axis during drilling. Furthermore, the operation of these bits are limited to narrow operating parameters, such as for short-length drilling, specific drilling parameters, and for straight-line only drilling.

It is therefore desirable that a polycrystalline diamond drill bit be constructed in a manner that will reduce or eliminate bit whirling during operation in drilling subterranean formations under a variety of operating parameters. It is desirable that the drill bit be constructed to accommodate straight-line or directional drilling, for either long or short length hole sections. It is desirable that the drill bit be configured in a manner that prevents bit whirling without sacrificing the service life and efficiency of the bit when compared to conventional drill bits. It is further desirable that the drill bit be constructed in a cost effective manner using conventional manufacturing techniques and using conventional materials of construction.

SUMMARY OF THE INVENTION

There is, therefore, provided in the practice of this invention a self-centering drill bit that includes a head portion having a plurality of cutting elements disposed thereon. The cutting elements are preferably polycrystalline diamond compacts arranged in blades that extend outwardly away from the surface of the bit head portion. The bit also includes a cavity that is centrally located on the bit head portion and is formed between end portions of adjacent blades. At least one cutting element is positioned adjacent an opening to the cavity to form a core portion from a subterranean formation that is also housed in the cavity during drilling operation of the bit.

The cavity includes wall portions formed from the blade end portions. The bit head is balanced to form a force of determined magnitude and direction from omnidirectional forces imposed on the bit during drilling. The force formed by the bit is transmitted by a predetermined section of the wall portions to the core portion disposed within the cavity, causing a countering force to be imposed by the core portion onto the wall portion that keeps the bit aligned with its rotational axis. At least the predetermined section of the wall portion has a smooth surface formed from a low friction abrasion resistant material such as thermally stable diamond, natural diamond and the like. The low friction abrasion resistant material may either be integral with the wall portion or non-integral in the form of inserts or the like that are brazed thereto.

A rigid element is disposed within the cavity and extends outwardly away from the surface of the head portion to reduce the core portion disposed within the cavity during drilling operation. The rigid element may be configured, depending on the hardness of the formation being drilled, to crush, break, cut or trim the core formed within the cavity upon contact. The use of the rigid element serves to reduce the length of the core formed within the cavity.

A drill bit constructed according to principles of this invention will not move off track from its rotational axis during drilling operation, enables use of the bit under a wide range of operating parameters, and reduces drilling time when compared to conventional drill bits.

BRIEF DESCRIPTION OF THE DRAWINGS

These and other features and advantages of the present invention will become appreciated as the same becomes better understood with reference to the specification, claims and drawings wherein:

DETAILED DESCRIPTION

Figure 1:
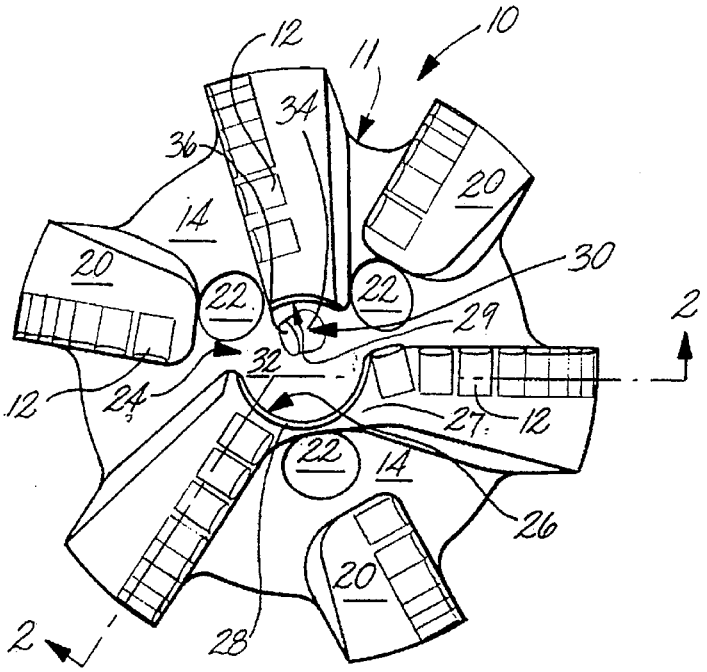
FIG. 1 is top elevational view of a first embodiment of a drill bit constructed according to principles of this invention.

Referring to FIG. 1, a first embodiment of a drill or drag bit 10 constructed according to principles of this invention, used to drill subterranean formations, preferably comprises a head portion 11 and a plurality of polycrystalline diamond compact (PDC) cutting elements 12 disposed around a face 14, shoulder 16, and gauge 18 portion of the bit head. Alternatively, the drill bit may comprise cutting elements formed from hard materials other than PDC. However, in a preferred first embodiment the cutting elements are formed from PDC. The PDC cutting elements may be serially arranged in a number of blades 20, some of which extend away from the face 14, over the shoulder 16 band to the gauge 18 portion of the bit. The bit may comprise any number of blades. For purposes of illustration, a bit having six blades is shown in FIG. 1. It is to be understood, however, that a bit constructed according to principles of this invention may be designed having any number of blades to accommodate drilling under a variety of different conditions.

The PDC bit 10 also includes a number of openings or nozzles 22 that extend through the face portion 14 of the bit. The nozzles 22 serve to dispense drilling fluid from inside the bit to the surface of the particular formation being drilled. The dispensed fluid facilitates the drilling operation by cooling the bit and removing drilling debris from the working area of the bit.

The PDC bit 10 includes a cavity 24 that is centrally located at the face portion 14 of the bit and that is formed between adjacent end portions of blades 20. Alternatively, rather than being formed by the blades, the cavity 24 can be formed from a recessed portion in the face portion 14 of the bit itself. However, it is desirable that the cavity be formed from end portions of the blades because the placement of one or more PDC cutting element 12 adjacent the end portion of the blade serves to cut a diameter of the drilled formation, thereby forming a core for placement within the cavity 24. Additionally, the use of adjacent blade end portions to form the cavity 24 provides openings in the cavity between each end portion to allow for broken, crushed, cut or trimmed core portions to be directed outwardly away from the cavity. The broken core portions are allowed to pass from the cavity along the face portion of the bit to the bore of the hole to join other drilling debris and, thereby, not interfere with the cutting and centering action of the bit.

Figure 2:
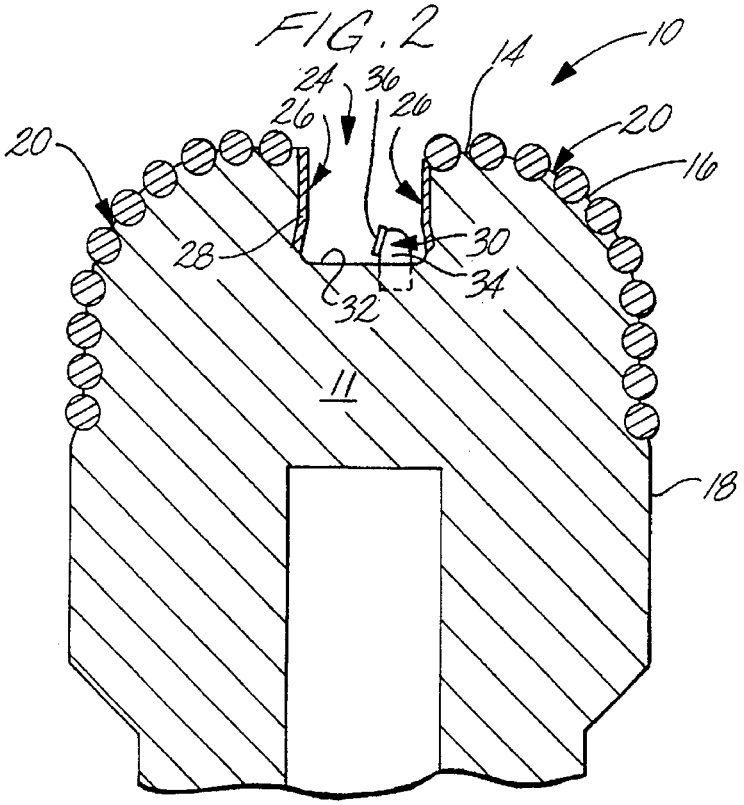
FIG. 2 is cross-sectional side elevation of the drill bit taken along lines 2—2 of FIG. 1.

The cavity 24 is configured in the form of a circular opening having a diameter and depth of predetermined dimension. In a preferred first embodiment, the cavity has a depth that corresponds to the approximate distance that each respective blade 20 deferring the cavity extends outwardly from the face portion 14 (as best shown in FIG. 2), wherein the depth is sufficient to provide a desired centering effect on the bit during operation. In a preferred first embodiment, for an 8½ inch drill bit, the cavity has a diameter of approximately 1½ inches and has a depth of approximately 1½ inches.

During the operation of the bit in drilling a bore hole, the PDC cutting element(s) 12 located adjacent the cavity opening acts to form a core portion from the formation that enters and travels into the cavity. Accordingly, as the remaining PDC cutting elements disposed around the blades of the bit act to cut away the formation and form the hole, a core portion is simultaneously being formed from the formation and fills the cavity.

The drill bit 10 is designed having a balanced bit head 11 that acts to take the omnidirectional forces that are imposed upon the bit, by action of the bit drilling within the bore hole, and from such forces form a force of predetermined magnitude and direction. The bit head is designed so that force formed by the balanced bit head is transmitted by a designated portion of the bit to an adjacent portion of the formed core. It is desired that the force or forces formed by the bit head have a sufficient magnitude and a specific direction to cause a resulting equal and opposite force, i.e., a countering force, to be imposed onto the designated portion of the bit by the formed core, thereby promoting alignment of the drill bit with its axis of rotation.

It has been discovered that the most effective manner of transmitting a force formed by the balanced bit head to the bore hole, and thereby cause a desired countering force of sufficient magnitude and direction to be imposed onto the bit, is by transmitting the force from a central position of the bit. Accordingly, a drill bit constructed according to principles of this invention is constructed having a balanced bit head that, during drilling operation of the drill bit, forms a force and transmits such force from a designated portion of the central cavity to an adjacent core portion. The force transmitted to the core portion in turn causes an equal and opposite countering force to be imposed onto the designated section of the central cavity.

In a preferred first embodiment, the balanced bit head 11 is designed to sum the omnidirectional forces that are imposed on the bit head by the bore hole, and form a force of predetermined magnitude and direction. The bit is designed to form a force having a magnitude and direction that, when transmitted by the cavity portion of the bit, causes a countering force of equal and opposite magnitude and direction to be imposed onto the bit that is sufficient to keep the bit aligned with its axis of rotation. As the drill bit is rotated within the formation, the bit acts to form the bore hole by action of the cutting elements, and simultaneously acts to form a core portion within the cavity. As the cavity rotates around the core portion the bit transmits a force from a designated portion of the cavity to the core portion, which causes a countering force to be imposed on the bit by the core portion. This countering force keeps the bit aligned with its rotational axis.

The drill bit 10 may have a balanced bit head 11 that is either symmetric or asymmetric in configuration. In a preferred first embodiment, the bit head has an asymmetric configuration as a result of balancing that is needed to form the force that is transmitted from the central cavity to an adjacent core portion and, thereby cause the desired countering force. The bit head may be balanced by varying a number of different bit characteristics such as by manipulating the geometrical characteristics of the blades or cutting elements, e.g., angular locations, radial and longitudinal coordinates, back and side rake angles and the like of the blades.

The placement of the centering device, i.e., a designated portion of the central cavity, at the center of the face portion 14 of the bit is advantageous because the face portion typically, and especially the center portion of the face portion, does not experience the same type of aggressive wear during drill bit operation as the shoulder portion 16. Therefore, decreasing the cutting element density at the face portion to accommodate the centering device does not sacrifice or adversely affect the service life of the bit.

The drill bit illustrated in FIG. 1 is designed having a balanced bit head 11. The bit head 11 is configured to take the omnidirectional forces imposed upon the bit during the drilling operation and form a force of sufficient magnitude and determined direction to, in turn cause a sufficient countering force to be imposed on the bit to eliminate or minimize bit whirling. The force formed by the bit head 11 is transmitted from a wall portion 26 and is directed toward an axis running along the length of the central, i.e., are directed toward wall portion 29. The wall portion 26 is formed by a bridge portion 27 connecting adjacent blade end portions together. The force is transmitted to an adjacent surface portion of a core disposed within the cavity during operation of the bit. The core, in reaction to such force, imposes an equal and opposite countering force onto the wall portion 26 to keep the drill bit aligned with it axis of rotation during operation.

It is desired that the wall portion 26 have a smooth low friction abrasion resistant surface 28 because of the force or forces that are transmitted by and imposed upon the wall portion 26 during drilling. Use of a low friction abrasion resistant surface maintains the rotational efficiency of the bit and protects the cavity wall from friction related wear, thereby enhancing the service life of the drill bit. The smooth low friction abrasion resistant surface 28 can either be integral with the wall portion 26 of the cavity 24 or can be formed from one or more non-integral inserts, that can be set flush with the cavity wall surface. In a preferred first embodiment, the smooth low friction abrasion resistant surface 28 is integral with the wall portion 26 and is formed during the formation of the face portion 14 of the bit. The material used to form the smooth low friction abrasion resistant surface may be selected from the group including thermally stable diamond (TSP), natural diamond, or any other type of hard thermally stable abrasion resistant material. A preferred material that is used to form the smooth low friction abrasion resistant surface is TSP.

A wall portion 29 of the cavity 24, independent from and opposite to the wall portion 26, also serves to a lessor extent to help keep the bit aligned with its rotational axis during drilling. Wall portion 29 helps to promote drill bit rotational alignment by effecting temporary contact with the core portion in the event that the axis of rotation of the bit is suddenly upset, such as when the bit engages domains of different hardnesses during drilling a nonuniform formation. Because wall portion 29 participates to a lessor extent than wall portion 26 in promoting rotational alignment of the bit, it can be formed having a surface different than that of wall portion 26. For example, the wall portion can be formed from the same material that is used to form the blades 20. However, depending on the particular application, e.g., the drilling of non-uniform formations where unsteady rotational operation of the drill bit is likely, the wall portion 29 may be formed having a smooth low friction abrasion resistant surface as described above for wall portion 26.

As shown in FIGS. 1 and 2, a first embodiment of the drill bit 10 includes a shear cutter 30 located at a base portion 32 of the cavity 24. The shear cutter 30 can either be an integral member of the base portion 32 or a non-integral insert formed from a hard and abrasion resistant material. In a preferred first embodiment, the shear cutter 30 is a non-integral insert in the form of a tungsten carbide stud 34 that extends outwardly a distance away from the base portion into the cavity. The tungsten carbide stud 34 includes a diamond wafer 36 that is brazed to a side portion of the stud. The shear cutter 30 is designed to engage a leading edge of the core during operation of the bit as the core is formed and travels through the cavity and toward the base portion. The shear cutter 30 cuts away the core by the core engaging the diamond wafer 36. Cut away portions of the core are passed from the cavity via the openings between the wall portions 26 and 29 of the cavity to the bore hole where they cannot interfere with the core cutting and centering operation. The shear cutter is preferably used in applications where a soft or medium hardness formation, which cannot be broken or crushed but must be cut, is to be drilled.

As the bit is operated to drill a hole, a core portion is formed by action of the blade ends against the formation. The core portion enters into the cavity and travels the length of the cavity until it engages the shear cutter, which cuts and thereby reduces the core portion. The use of the rock bit comprising the cavity 24 and core shear cutter 30 forms a core of sufficient length to provide a desired centering action without the need to remove the bit from the bore hole to remove the core portion and, therefore, does not limit use of the bit to either short drilling lengths or straight-line only drilling.

Figure 3:
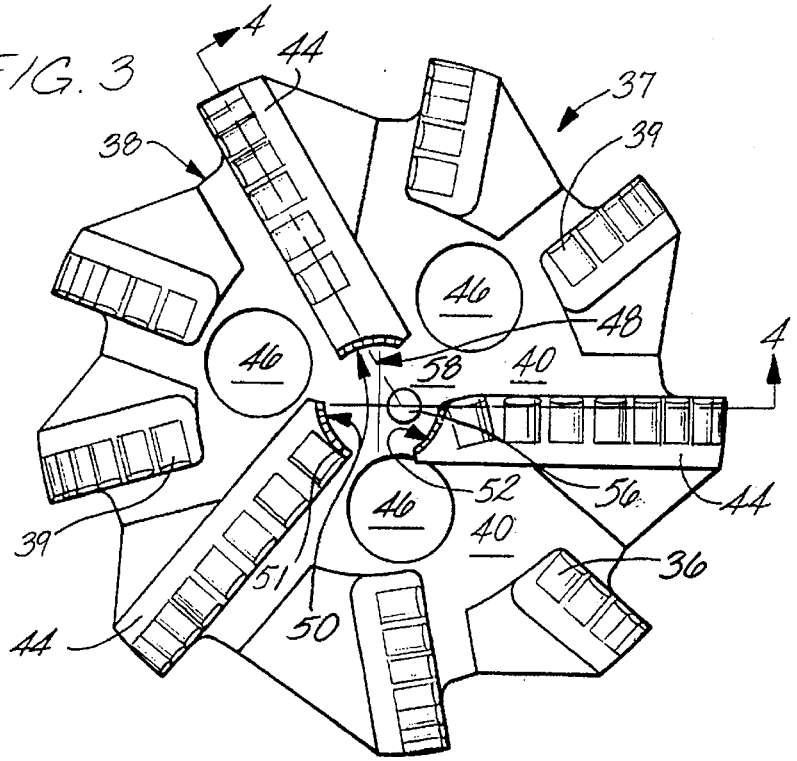
FIG. 3 is a top plan view of a second embodiment of a drill bit constructed according to principles of this invention.
Figure 4:
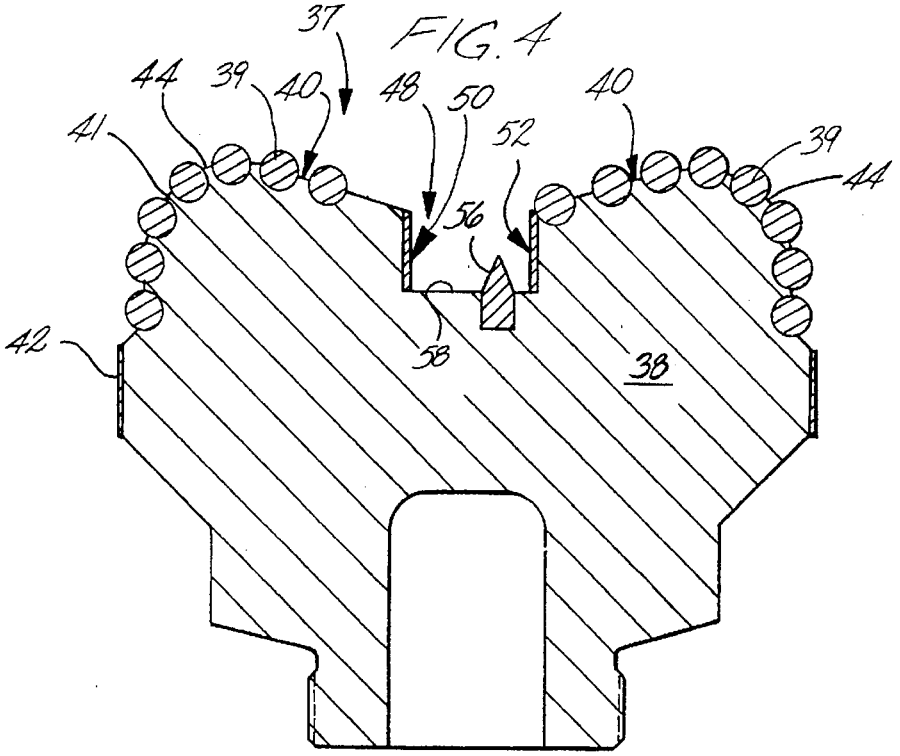
FIG. 4 is a cross-sectional side elevation of the drill bit taken along lines 4—4 of FIG. 3.

Referring to FIGS. 3 and 4, a second embodiment of a drill bit 37 is illustrated. The drill bit 37 has a head portion 38 that includes PDC cutting elements 39, a face portion 40, shoulder portion 41, gauge portion 42, blades 44, and nozzles 46 as previously described for the first embodiment. The drill bit 37 has nine blades, three of which extend from the face portion 40, over the shoulder portion 41, and to the gauge portion 42 of the bit. The remaining six blades extend only partially over the face portion, over the shoulder, and to the gauge position.

The drill bit 37 includes a centrally located cavity 48 at the face portion 40 that is formed between adjacent end portions of the three oppositely arranged independent blades 44. The cavity 48 serves the same purpose as that previously described for the first embodiment, i.e., to keep the bit aligned with its rotational axis during drilling operation by retaining a core portion therein and transmitting a force to such core portion. The cavity 48 is configured having a predetermined diameter and depth that corresponds to the distance that the blade ends are positioned away from each other, and the distance that the blade extends outwardly away from the face portion 40 of the bit, respectively. At least one cutting element 39 is located adjacent to the opening of the cavity 40 to cut along a diameter portion of the formation to form the core.

The drill bit 37 is designed having an balanced bit head 38 as previously described in the first embodiment. Specifically, the bit head 38 is balanced by using one or more designated blades 44 that are of unequal length. The balanced bit head is designed to function in the same manner as previously described for the first embodiment, i.e., to take the omnidirectional forces that are imposed upon the bit, form a force of sufficient magnitude and determined direction, transmit such force from a wall portion of the cavity to an adjacent core disposed within the cavity, and cause an equal and opposite countering force to be imposed on the wall portion by the core portion to keep the drill bit aligned with its axis of rotation. In this second embodiment, the balanced bit head design forms a force that is transmitted by two non-continuous wall portions 50 to an adjacent core portion within the cavity during drilling operation. The force formed by the bit head is directed toward the axis running along the length of the cavity, i.e., generally towards wall portion 52.

Wall portions 50 are formed from end portions of two adjacent non-integral blades 44. Each individual wall portion 50 is shaped in the form of a circular section to facilitate placement adjacent to a core portion formed by operation of the bit and disposed within the cavity 50. Wall portions 50 include a smooth low friction abrasion resistant surface 51 that can be either integral with or non-integral member of the wall 50, as previously described for the first embodiment. The smooth low friction abrasion resistant surface can be formed from the same materials previously described for the first embodiment. In a preferred second embodiment, the smooth low friction abrasion resistant surface 51 is formed from a plurality of non-integral inserts that are set flush with the wall surface and that are formed from natural diamond and TSP.

A wall portion 52 is arranged opposite to wall portions 50 and serves to a lessor extent to center the drill bit during drilling operation in the same manner previously described for wall portion 29 in the first embodiment. Accordingly, wall portion 52 may be formed from the same material as the blades 44 or, if desired, can be formed having the same smooth low friction abrasion resistant surface as that of wall portion 50.

The drill bit 37 includes a core breaker 56 disposed within the cavity 48 located at a base 58 of the cavity formed from the surface of the face portion 38 of the bit. As best shown in FIG. 4, the core breaker 56 is a rigid element configured in the shape of a cone that extends outwardly away from the base 58. The core breaker serves to break up or crush the core during operation of the bit by engaging a leading edge of the core as the core travels into and fills the cavity. The broken or crushed core particles exit the cavity via openings between the blade ends that define the wall portions of the cavity and are directed across the face portion of the bit to the bore hole, thereby preventing buildup of core particles in the cavity.

It is to be understood that the core breaker 56 can be configured having a shape different than a cone as illustrated in FIG. 4, as long as the shape acts to break up the core portion upon contact therewith. Additionally, it is to be understood that the bit may be configured having more than one core breaker. The core breaker 56 may also either be formed as an integral element of the face portion of the bit or as a non-integral insert made from a hard abrasion resistant material. In a preferred second embodiment, the core breaker is a non-integral diamond enhanced insert (DEI) that is inserted into the face portion 38 of the bit and is formed from tungsten carbide coated with diamond. A core breaker 56 of the type described above and illustrated in FIG. 4 is useful in applications where a hard formation is being drilled so that a core portion formed by the cavity can be easily crushed or broken.

A PDC bit constructed according to the embodiments described and illustrated above, comprising the centrally located core-forming and retaining cavity, keeps the bit aligned with its rotational axis and reduces bit whirling without sacrificing cutting element density at the shoulder portion of the bit, thereby enhancing the effective service life of the bit. The PDC bit comprising a centrally located centering device also facilitates use of the bit under a variety of different operating conditions, e.g., rotational speed (RPM) and weight-on-bit, without having to worry about forces being imposed on relatively non-protected portions of the bit, i.e., portions of reduced cutting element density.

Additionally, the PDC bit constructed according to principles of this invention has a faster rate of penetration than conventional PDC drill bits, allowing for reduced drilling times. It is believed that the faster rate of penetration is due to the action of the PDC bit in forming a core portion from the formation rather than drilling the entire formation.

The use of differently configured core removing devices, i.e., a core breaker or core shear cutter, allows the PDC bit to be used in drilling formations that have a variety of different hardnesses. Also, use of the bit is not limited to drilling short-length holes because the core that is formed for centering the bit is broken or cut away from the bit during operation, thereby eliminating the need for frequent removal of the bit from the hole.

Although limited embodiments of the PDC bit have been described herein, many modifications and variations will be apparent to those skilled in the art. Principles of this invention relate generally to the construction of a drill bit having a balanced bit head design for taking forces that are imposed on the bit during drilling operation, forming a force of sufficient magnitude and determined direction, transmitting the force from designated portion or portions of a centrally located cavity in the bit to an adjacent core portion disposed within the cavity, and causing an equal and opposite countering force to be imposed onto the designated portion or portions to keep the drill bit aligned with its axis of rotation. It is, therefore, to be understood that drill bits constructed according to principles of this invention may be designed having a balanced bit head configured differently than that specifically described or illustrated, which includes a central cavity having a wall portion configured to take into account such design and effect the transmission and receipt of such aforementioned forces. Drill bits having such different balanced bit head configurations are intended to be within the scope of this invention.

Accordingly, it is to be understood that, within the scope of the appended claims, the PDC bit constructed according to principles of invention may be embodied other than as specifically described herein.

What is claimed is:

1. A self-centering drill bit for drilling subterranean formations comprising:

a head portion;

a number of blades running transversely across a surface of the head portion and each extending perpendicularity outwardly away from the surface of the head portion, each blade including a plurality of cutting elements disposed thereon; and a centrally located cavity disposed on the surface of the head portion, the cavity having walls formed from adjacent surface portions of the blades, wherein the cavity has a substantially uniform diameter extending from a cavity opening to a flat cavity floor at the head surface, wherein at least one surface portion of the cavity wall is formed from a low friction abrasion resistant material; and means disposed within the cavity for limiting the core disposed within the cavity during drilling operation of the bit to a predetermined length, the means being static within the cavity and extending from the cavity floor;

wherein the cavity includes at least one open wall section between adjacent blades to permit passage of broken core pieces away from the cavity; and wherein at least one of the blades and the cutting elements is arranged on the head portion to cause the drill bit to transmit a centering force from the cavity wall surface onto an adjacent surface of a core that is formed from the formation during drilling operation of the bit to cause the drill bit to be self-centering during drilling.

2. The self-centering drill bit as recited in claim 1 wherein at least one element selected from the group consisting of the blades, and the cutting inserts are arranged on the heat so that the head has an asymmetric configuration.

3. The self-centering drill bit as recited in claim 1 wherein the at least two blades extend from a face portion of the bit head, over a shoulder portion, and to a gauge portion of the bit head.

4. The self-centering drill bit as recited in claim 1 wherein the low friction abrasion resistant material is selected from the group consisting of thermally stable diamond and natural diamond.

5. The self-centering drill bit as recited in claim 4 wherein the cavity wall surface portion formed from the low friction abrasion resistant material is an integral member of the cavity wall surface.

6. The self-centering cutting drill as recited in claim 4 wherein the cavity wall surface portion formed from the low friction abrasion resistant material is a non-integral member of the cavity wall surface in the form of an insert.

7. The self-centering drill bit as recited in claim 1 wherein the core limiting means comprises a rigid member arranged axially offset within the cavity extends outwardly away from the cavity floor a predetermined distance, and that is adapted to contact a bottom surface of the core.

8. The self-centering drill bit as recited in claim 7 wherein the rigid member is configured having a geometric shape effective in crushing a core portion upon contact therewith.

9. The self-centering drill bit as recited in claim 7 wherein the rigid member is configured having a geometric shape effective in cutting a core portion upon contact therewith.

10. A self-centering drill bit for drilling subterranean formations, the drill bit comprising:

a head portion;

a number of blades arranged transversely across a surface of the head portion, each blade extending outwardly away from the surface of the head portion;

a plurality of cutting elements arranged on the blades, at least one of the blades and the cutting elements being arranged on the head portion to permit a portion of the drill bit to transmit a centering force onto a core formed from the formation during drilling operation of the bit;

a cavity located centrally on the surface of the head portion, the cavity having wall surfaces formed from centrally located adjacent end portions of at least two blades, wherein the cavity extends from substantially flat cavity floor formed from the surface of the head portion to an upper-most surface of the blades forming the cavity wall surface, the cavity having an approximately constant diameter, wherein at least one cutting element disposed on a blade is positioned adjacent an opening to the cavity to form the core from the formation during drilling operation of the bit, wherein the cavity includes at least one wall surface formed from a low friction abrasion resistant material different than remaining wall surface materials, wherein the cavity includes at least one open wall section for removing core particles therefrom, and wherein the centering force is transmitted from the cavity wall surface to an adjacent wall surface of the core to center the drill bit about its rotational axis; and means included within the cavity for limiting the core formed in the cavity to a predetermined length, the means being static within the cavity.

11. The self-centering drill bit as recited in claim 10 wherein the cavity surface formed from the low friction abrasion resistant material is formed from non-integral inserts, and wherein the inserts are formed from a material selected from the group consisting of thermally stable diamond and natural diamond.

12. The self-centering drill bit as recited in claim 10 wherein at least one of the blades and the cutting elements are arranged on the head portion so that the head portion has an asymmetric configuration.

13. The self-centering drill bit as recited in claim 10 wherein the plurality of cutting elements are formed from polycrystalline diamond compact.

14. The self-centering drill bit as recited in claim 10 wherein the cavity wall surface formed from the low friction abrasion resistant material is integral with the wall and is formed from a material selected from the group consisting of thermally stable diamond and natural diamond.

15. The self-centering drill bit as recited in claim 10 wherein the core limiting means comprises a rigid element that extends outwardly away from the cavity floor a predetermined distance into the cavity.

16. The self-centering drill bit as recited in claim 15 wherein the rigid element is configured to crush a portion of the core passing through the cavity that comes into contact with such rigid element.

17. The self-centering drill bit as recited in claim 16 wherein the rigid element is configured in the shape of a cone.

18. The self-centering drill bit as recited in claim 15 wherein the rigid element includes a cutting surface to cut away a portion of the core passing through the cavity that comes into contact with such rigid element.

19. A self-centering polycrystalline diamond compact drill bit for drilling subterranean formations comprising:

a bit head having a face portion, a shoulder portion, and a gauge portion;

a number of cutting blades disposed transversely along the bit head and extending outwardly away from a surface of the bit head;

a plurality of polycrystalline diamond compact cutting elements disposed on the blades, wherein at least one of the blades and the cutting elements are arranged on the bit head to produce a centering force for transmitting from a portion of the bit head to the formation;

a cavity centrally located on a surface of the face portion of the bit head, the cavity being adapted to accommodate a core formed from the formation therein, the cavity including wall surfaces formed from adjacent terminal end surfaces of at least two blades, wherein at least one of such wall surface is formed from a low friction abrasion resistant material, and wherein the centering force is transmitted from the wall surface comprising such low friction abrasion resistant material to an adjacent surface of a core disposed in the cavity formed from the formation during drilling operation of the bit; and a rigid element disposed statically within the cavity for reducing the core portion to a predetermined length, wherein the cavity includes at least one open wall section for removing core particles therefrom.

20. The self-centering drill bit as recited in claim 19 wherein the rigid element extends outwardly from the head surface a predetermined distance and is configured to crush an adjacent portion of the core within the cavity upon contact therewith.

21. The self-centering drill bit as recited in claim 19 wherein the rigid element extends outwardly from the head surface a predetermined distance and is configured to cut an adjacent portion of the core within the cavity upon contact therewith.

22. The self-centering drill bit as recited in claim 19 wherein the cavity has a depth approximately equal to a distance that each wall forming blade extends outwardly away from the bit head surface, and wherein the cavity has an approximately constant diameter.

23. The self-centering drill bit as recited in claim 19 wherein the cavity wall surface formed from the low friction abrasion resistant material is an integral member of the wall and is formed from a material selected from the group consisting of thermally stable diamond and natural diamond.

24. The self-centering drill bit as recited in claim 19 wherein cavity wall surface formed from the low friction abrasion resistant material is formed from inserts that are non-integral with the wall and that are formed from a material selected from the group consisting of thermally stable diamond and natural diamond.

25. A self-centering drill bit comprising:

a bit head having a number of cutting blades disposed on a surface thereof and extending outwardly therefrom, wherein each cutting blade includes a number of cutting elements arranged thereon for engaging a subterranean formation; and a cavity centrally located on the bit head surface for housing a core portion formed from the formation by action of the cutting elements, the cavity having wall surfaces formed from adjacent terminal ends of at least two blades, a generally flat cavity floor defined by the head surface, at least one open wall section between two blades, and an approximately constant cavity diameter; and means for limiting the core portion disposed within the cavity to a predetermined length, wherein core particles are removed from the cavity by the open wall sections, wherein at least one of the blades and the cutting elements are arranged on the bit head to form and transmit a centering force to a wall surface of the core portion by the cavity wall surface, and wherein at least one cavity wall surface is formed from a low friction abrasion resistant material.

26. The self-centering drill bit as recited in claim 25 wherein the cutting elements are formed from polycrystalline diamond compact.

27. The self-centering drill bit as recited in claim 26 wherein the at least one cavity wall surface formed from the low friction abrasion resistant material is selected from the group of materials consisting of thermally stable diamond and natural diamond.

28. The self-centering drill bit as recited in claim 27 wherein the core limiting means comprises a rigid element disposed within the cavity that extends outwardly a distance from the cavity floor for engaging and reducing an adjacent portion of the core after it travels through the cavity.

29. The self-centering drill bit as recited in claim 28 wherein the bit head is designed having an asymmetric configuration.

* * * * *